US011320154B2

(12) United States Patent
Fukaya et al.

(10) Patent No.: US 11,320,154 B2
(45) Date of Patent: May 3, 2022

(54) HOT-WATER SUPPLY APPARATUS

(71) Applicant: RINNAI CORPORATION, Nagoya (JP)

(72) Inventors: Atsushi Fukaya, Aichi (JP); Shigeki Takeuchi, Aichi (JP)

(73) Assignee: RINNAI CORPORATION, Nagoya (JP)

( * ) Notice: Subject to any disclaimer, the term of this patent is extended or adjusted under 35 U.S.C. 154(b) by 390 days.

(21) Appl. No.: 16/668,075

(22) Filed: Oct. 30, 2019

(65) Prior Publication Data

US 2020/0309382 A1 Oct. 1, 2020

(30) Foreign Application Priority Data

Mar. 25, 2019 (JP) ..... JP2019-056338

(51) Int. Cl.
*F24D 3/08* (2006.01)
*F24D 19/10* (2006.01)
*F24H 1/52* (2022.01)

(52) U.S. Cl.
CPC ..... *F24D 3/08* (2013.01); *F24D 19/1066* (2013.01); *F24H 1/52* (2013.01); *F24D 2220/0235* (2013.01)

(58) Field of Classification Search
CPC ..... F24D 3/08; F24D 19/1066; F24H 1/52; F24F 11/89
See application file for complete search history.

(56) References Cited

U.S. PATENT DOCUMENTS

2007/0205293 A1* 9/2007 Kwak ..... F24D 3/08 236/21 B

FOREIGN PATENT DOCUMENTS

| | | | | |
|---|---|---|---|---|
| DE | 19628707 A1 * | 1/1997 | ..... | F24D 19/1012 |
| GB | 2414535 A * | 11/2005 | ..... | F23N 5/242 |
| JP | 2006090604 A * | 4/2006 | | |
| JP | 2018-071925 | 5/2018 | | |

OTHER PUBLICATIONS

Enge, et al., DE 19628707 A1 English machine translation, Jan. 16, 1997 (Year: 1997).*

* cited by examiner

*Primary Examiner* — Edelmira Bosques
*Assistant Examiner* — Phillip Decker
(74) *Attorney, Agent, or Firm* — Rankin, Hill & Clark LLP

(57) ABSTRACT

The present invention improves the user-friendliness of a hot-water supply apparatus when using hot water supply and air conditioning. A switching control unit 27, which switches between heat medium flow paths 4 and 5 according to an air conditioning ready state or a hot-water supply ready state, switches a heat medium flow path to the hot-water supply ready state by a switching valve 21 in the case where air conditioning is not used by the time an air conditioning standby time elapses during standby in the air conditioning ready state.

9 Claims, 4 Drawing Sheets

HOT-WATER SUPPLY APPARATUS

BACKGROUND OF THE INVENTION

1. Field of the Invention

The present invention relates to a hot-water supply apparatus used by being switched between air conditioning and hot-water supply by a user.

2. Description of the Related Art

Hitherto, there has been known a hot-water supply apparatus that performs hot water supply and heating in a balanced manner by using a single heating unit (refer to, for example, Patent Document 1). According to this hot-water supply apparatus, a heat medium that has been heated by a combustion unit is supplied to a heat medium flow path for heating or a heat medium flow path for hot water supply, by switching.

A heating terminal is connected to the heat medium flow path for heating, and heating is performed by the heat medium that has been heated by the combustion unit. A heat exchanger for hot water supply is connected to the heat medium flow path for hot water supply. The heat exchanger for hot water supply is provided with a hot-water supply passage having the upstream end thereof connected to a water pipe or the like and the downstream end thereof provided with a hot water tap, such as a faucet. When the heat medium that has been heated by the combustion unit flows into the heat medium flow path for hot water supply, the water in the hot-water supply passage is heated by the heat exchanger for hot water supply to generate hot water.

The switching between the heat medium flow path for air conditioning and the heat medium flow path for hot water supply in the hot-water supply apparatus is accomplished by a three-way valve provided at the branching point of the heat medium flow path for air conditioning and the heat medium flow path for hot water supply.

The three-way valve closes the heat medium flow path for hot water supply and opens the heat medium flow path for air conditioning when a user performs an operation for starting the operation of a heating terminal (for example, by turning on the heating switch of a remote control or the like). Further, the three-way valve closes the heat medium flow path for air conditioning and opens the heat medium flow path for hot water supply when the user performs an operation for starting hot water supply (for example, by opening a hot water tap).

PRIOR ART DOCUMENT

Patent Document

Patent Document 1: Japanese Patent Application Laid-Open No. 2018-71925

In a standby state in which neither heating nor hot-water supply is being performed, the three-way valve for switching between the heat medium flow path for air conditioning and the heat medium flow path for hot water supply is held in a state immediately before heating or hot-water supply. For this reason, if a user starts the hot-water supply while the three-way valve is standing by with the heat medium flow path for air conditioning opened (air conditioning ready state), then the supply of a heat medium to the heat exchanger for hot-water supply is delayed until the three-way valve opens the heat medium flow path for hot water supply (until the hot-water supply ready state is set), thus leading to inconvenient delay of the startup when the hot-water supply is used.

SUMMARY OF THE INVENTION

In view of the above background, an object of the present invention is to provide a hot-water supply apparatus capable of improving the startup of hot-water supply and the startup of air conditioning thereby to achieve improved user-friendliness.

To this end, according to a first aspect of the invention, there is provided a hot-water supply apparatus including: an operation unit that enables a user to select either an air conditioning mode or a hot-water supply mode; a flow path switching unit that switches a heat medium flow path according to an air conditioning ready state or a hot-water supply ready state; a switching control unit that controls the flow path switching unit; and a pump unit that forcibly causes a heat medium in the heat medium flow path to flow, wherein the switching control unit actuates the flow path switching unit to switch the heat medium flow path to the hot-water supply ready state in the case where no operation for using air conditioning is performed through the operation unit by the time an air conditioning standby time set in advance elapses during standby, with the heat medium flow path being set to the air conditioning ready state while the pump unit is at rest.

According to the first aspect of the invention, during the standby with the heat medium flow path set for the air conditioning ready state, if the user does not use air conditioning after the air conditioning standby time elapses, then the switching control unit switches the heat medium flow path to the hot-water supply ready state. As the time of the standby state in which air conditioning is stopped, the air conditioning standby time can be set to a relatively long time (e.g., 20 to 30 hours) that exceeds a time at which the user may use the air conditioning. If the air conditioning is not used for a relatively long time, then it can be regarded that it is less likely that the air conditioning will be used thereafter.

Thus, if the air conditioning is not used for a relatively long time, then the heat medium flow path can be switched to the hot-water supply ready state and stand by for the use of the hot-water supply. This enables the startup to be improved when the hot-water supply is used, leading to improved user-friendliness.

Further, according to a second aspect of the invention, there is provided a hot-water supply apparatus including: an operation unit that enables a user to select either an air conditioning mode or a hot-water supply mode; a flow path switching unit that switches a heat medium flow path according to an air conditioning ready state or a hot-water supply ready state; a switching control unit that controls the flow path switching unit; and a pump unit that forcibly causes a heat medium in the heat medium flow path to flow, wherein an absence detection unit that detects absence of a user is provided, the switching control unit actuates the flow path switching unit to switch the heat medium flow path to the hot-water supply ready state in a case where the absence of the user is not detected by the absence detection unit and no operation for using air conditioning is performed through the operation unit by a time an air conditioning standby time elapses during standby in which the heat medium flow path is in the air conditioning ready state while the pump unit is at rest, and the switching control unit holds the heat medium flow path in the air conditioning ready state even in the case where the operation for using the air conditioning is not performed through the operation unit by the time the air conditioning standby time elapses in a case where the absence of the user is detected by the absence detection unit.

If the user is absent, then neither the air conditioning nor the hot-water supply is used. Further, if the user is temporarily absent, then it is highly likely that the user will use the air conditioning when the user returns home. Hence, even when the air conditioning is not used for a relatively long time, the heat medium flow path is kept in the air conditioning ready state when the absence is detected by the absence detection unit. This enables the heat medium flow path to be switched to the air conditioning ready state and to stand by in this state, thus preparing for the use of the air conditioning by the user returning home. Thus, the user-friendliness can be improved by improving the startup when the air conditioning is used.

The absence detection unit detects the absence of a user in the case where the operation for using the hot-water supply through the operation unit is not performed by the time the air conditioning standby time elapses, with the heat medium flow path being set to the air conditioning ready state by the switching control unit.

With this arrangement, the absence of the user can be easily determined in the case where neither the air conditioning nor the hot-water supply is used within the air conditioning standby time.

Further, in each of the hot-water supply apparatus according to the first aspect of the invention and the hot-water supply apparatus according to the second aspect of the invention, the switching control unit preferably sets the heat medium flow path to the hot-water supply ready state until a hot-water supply standby time set in advance to be shorter than the air conditioning standby time elapses, in a case where the flow path switching unit is actuated to switch the heat medium flow path to the hot-water supply ready state in response to the operation for using the hot-water supply performed through the operation unit, while waiting for the elapse of the air conditioning standby time with the heat medium flow path being set to the air conditioning ready state.

If the hot-water supply is used, then it is likely that the hot-water supply will be used again in a relatively short time. To prepare for the possible next use, when the hot-water supply is used intermittently at short intervals, setting the hot-water supply standby time to be shorter than the air conditioning standby time (preferably a few minutes, e.g., 3 to 10 minutes) makes it possible to improve the startup by setting the heat medium flow path in the hot-water supply ready state. Further, setting the hot-water supply standby time to be shorter than the air conditioning standby time enables the heat medium flow path to be reset to the air conditioning ready state to prepare for the use of the air conditioning.

Further, each of the hot-water supply apparatus according to the first aspect of the invention and the hot-water supply apparatus according to the second aspect of the invention includes, as a mode, a combustion unit for heating the heat medium in the heat medium flow path. The heat medium can be heated relatively quickly by the combustion unit. This makes it possible to achieve a higher speed of starting up the heating or the hot-water supply.

Further, each of the hot-water supply apparatus according to the first aspect of the invention and the hot-water supply apparatus according to the second aspect of the invention includes, as another mode, a heat pump that selectively performs the heating operation for heating the heat medium in the heat medium flow path or the cooling operation for cooling the heat medium in the heat medium flow path. This makes it possible not only to perform the heating by supplying the heat medium heated by the heat pump to an air conditioning terminal but also to perform the cooling by supplying the heat medium cooled by the heat pump to the air conditioning terminal.

DESCRIPTION OF THE PREFERRED EMBODIMENTS

Figure 1:
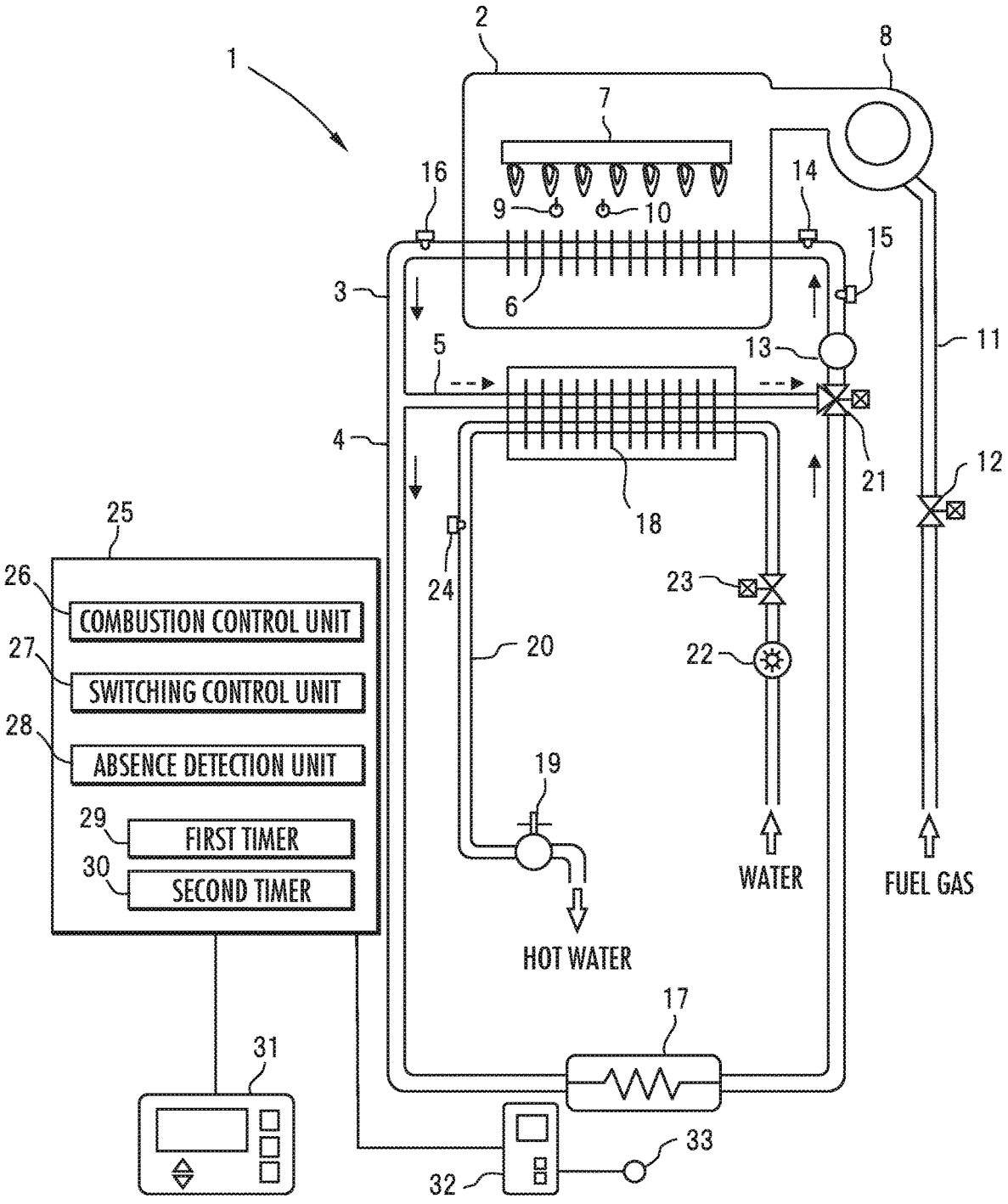
FIG. 1 is a configuration diagram of a hot-water supply apparatus.

An embodiment of the present invention will be described with reference to the accompanying drawings. Referring to FIG. 1, a hot-water supply apparatus 1 according to the present embodiment includes a combustion unit 2, a heat medium generation passage 3, a heat medium flow path for heating 4, and a heat medium flow path for hot water supply 5. The heat medium generation passage 3, the heat medium flow path for heating 4, and the heat medium flow path for hot water supply 5 constitute the heat medium flow path of the present invention.

The combustion unit 2 includes a heat medium heat exchanger 6 to which the heat medium generation passage 3 is connected, a burner 7 that heats the heat medium heat exchanger 6, and a combustion fan 8. An ignition electrode 9 for igniting the burner 7, and a flame rod 10 that detects the flame of the burner 7 are provided in the vicinity of the burner 7. The combustion fan 8 forcibly sends a mixed gas, which is generated by mixing a fuel gas and a combustion air supplied from a gas supply passage 11, to the burner 7. The gas supply passage 11 is provided with a gas variable valve 12 which changes the opening degree thereof to change the supply flow rate of the fuel gas.

The heat medium generation passage 3 is provided with a circulation pump 13 which circulates a heat medium (water, antifreeze or the like). The circulation pump 13 corresponds to a pump unit in the present invention. Further, the heat medium generation passage 3 is provided with an inlet temperature sensor 14 which detects the temperature of the heat medium flowing into the heat medium heat exchanger 6, a pressure sensor 15 which detects the pressure in the vicinity of the inlet of the heat medium heat exchanger 6, and an outlet temperature sensor 16 which detects the temperature of the heat medium flowing out of the heat medium heat exchanger 6.

The heat medium generation passage 3 includes the heat medium flow path for heating 4 and the heat medium flow path for hot water supply 5, which are connected in parallel. A heating terminal 17 is connected to the heat medium flow path for heating 4. A hot-water supply heat exchanger 18 is connected to the heat medium flow path for hot water supply 5. Further, a hot-water supply passage 20 having the upstream end thereof connected to water supply (not illustrated) and the downstream end thereof connected to a hot water tap 19, such as a faucet, is connected to the hot-water supply heat exchanger 18. The hot-water supply heat exchanger 18 exchanges heat between a heated heat medium passing through the heat medium flow path for hot water supply 5 and the water passing through the hot-water supply passage 20, thereby heating the water passing through the hot-water supply passage 20.

A switching valve 21 known as a three-way valve is provided at one connection position (branching position) of the heat medium flow path for heating 4 and the heat medium flow path for hot water supply 5. The switching valve 21 opens the heat medium flow path for heating 4 and closes the heat medium flow path for hot water supply 5 to allow communication between the heat medium generation passage 3 and the heat medium flow path for heating 4, thus setting the air conditioning ready state. Further, the switching valve 21 closes the heat medium flow path for heating 4 and opens the heat medium flow path for hot water supply 5 to allow communication between the heat medium generation passage 3 and the heat medium flow path for hot water supply 5, thus setting the hot-water supply ready state. The switching valve 21 corresponds to the flow path switching unit in the present invention.

The hot-water supply passage 20 is provided with a flow rate sensor 22 which detects the flow rate of the water flowing into the hot-water supply passage 20, a flow rate variable valve 23 which changes the opening degree to change the flow rate of the water flowing into the hot-water supply passage 20, and a tapping temperature sensor 24 which detects the temperature of the hot water in the hot-water supply passage 20 heated by the hot-water supply heat exchanger 18.

The hot-water supply apparatus 1 is further provided with a controller 25. The controller 25 includes a combustion control unit 26 which controls the combustion of the burner 7, a switching control unit 27 which controls the switching valve according to an operation state, an absence detection unit 28 which detects the absence of a user, a first timer 29, a second timer 30, and other control units (not illustrated) as the functions thereof. The switching control unit 27 of the controller 25 corresponds to the switching control unit in the present invention, and the absence detection unit 28 corresponds to the absence detection unit in the present invention.

The controller 25 receives detection signals from the flame rod 10, the inlet temperature sensor 14, the pressure sensor 15, the outlet temperature sensor 16, the flow rate sensor 22, and the tapping temperature sensor 24. Further, the operations of the burner 7, the ignition electrode 9, the switching valve 21, the circulation pump 13, the gas variable valve 12, the combustion fan 8, and the flow rate variable valve 23 are controlled by the control signals output from the controller 25.

A hot-water supply remote control 31 for remotely controlling the hot-water supply apparatus 1 is connected to the controller 25, and operation signals (signals instructing the setting of operating conditions, such as a hot water set temperature, the start of the heating operation, and the like) are input to the controller 25 according to the operations performed by a user through the hot-water supply remote control 31. Further, a heating remote control 32 for remotely controlling the heating terminal 17 is connected to the controller 25. The heating remote control 32 transmits signals that indicate, for example, a heating start/stop instruction, a heating set temperature, and a room temperature detected by a room temperature sensor 33, to the controller 25.

The hot-water supply apparatus 1 starts the heating operation, which is the air conditioning operation, when the user performs the heating start operation through the hot-water supply remote control 31 or the heating remote control 32, and performs the hot-water supply operation when the user opens the hot water tap 19. The hot-water supply remote control 31, the heating remote control 32, and the hot water tap 19 in the present embodiment correspond to the operation unit in the present invention.

In the heating operation, the switching control unit 27 of the controller 25 actuates the switching valve 21 to close the heat medium flow path for hot water supply 5 and open the heat medium flow path for heating 4. This allows communication between the heat medium generation passage 3 and the heat medium flow path for heating 4, thus setting the air conditioning ready state. Subsequently, the controller 25 actuates the circulation pump 13 to circulate the heat medium to a circulation flow path constituted of the heat medium generation passage 3 and the heat medium flow path for heating 4. Under this condition, the combustion control unit 26 of the controller 25 controls the combustion of the burner 7 such that the temperature detected by the room temperature sensor 33 reaches the vicinity of a heating set temperature, thus performing the heating operation.

Then, when the user performs the operation for stopping the heating through the hot-water supply remote control 31 or the heating remote control 32, the controller 25 stops the operations of the burner 7 and the circulation pump 13 to terminate the heating operation.

The hot-water supply operation is performed when the flow rate detected by the flow rate sensor 22 monitored by the controller 25 becomes equal to or more than a threshold value flow rate (which is set, assuming that the hot water tap 19 is open).

In the hot-water supply operation, the switching control unit 27 of the controller 25 actuates the switching valve 21 to open the heat medium flow path for hot water supply 5 and close the heat medium flow path for heating 4. This allows communication between the heat medium generation passage 3 and the heat medium flow path for hot water supply 5 to set the hot-water supply ready state. Subsequently, the controller 25 actuates the circulation pump 13 to circulate the heat medium to the circulation flow path constituted of the heat medium generation passage 3 and the heat medium flow path for hot water supply 5. Under this condition, the combustion control unit 26 of the controller 25 controls the combustion of the burner 7 such that the temperature detected by the tapping temperature sensor 24 reaches a desired hot water temperature set by the hot-water supply remote control 31.

When the heated heat medium flows into the heat medium flow path for hot water supply 5, the hot-water supply heat exchanger 18 performs heat exchange between the heated heat medium passing through the heat medium flow path for hot water supply 5 and the water passing through the hot-water supply passage 20, and the water passing through the hot-water supply passage 20 is heated, generating hot water. The hot-water supply operation causes hot water to come out from the hot water tap 19 that has been opened.

When the operation for closing the hot water tap 19 performed by the user is detected on the basis of the flow rate detected by the flow rate sensor 22, the controller 25 stops the operations of the burner 7 and the circulation pump 13 to terminate the hot-water supply operation.

Upon the ending of the heating operation, the controller 25 maintains the air conditioning ready state. This eliminates the time lag caused mainly by the switching operation of the switching valve 21 when the heating operation is performed again, thus enabling the heating effect to be quickly started. Further, upon the end of the hot-water supply operation, the controller 25 maintains the hot-water supply ready state. This eliminates the time lag caused mainly by the switching operation of the switching valve 21, thus enabling a quick startup of tapping from the hot water tap 19.

Based on the above, the controller 25 is adapted to select the state of the switching valve 21 during the standby (when the burner 7 and the circulation pump 13 are at rest) according to the status of the heating operation or the hot-water supply operation. The operation of the switching control unit 27 of the controller 25 at this time will be described with reference to the flowchart illustrated in FIG. 2.

Figure 2:
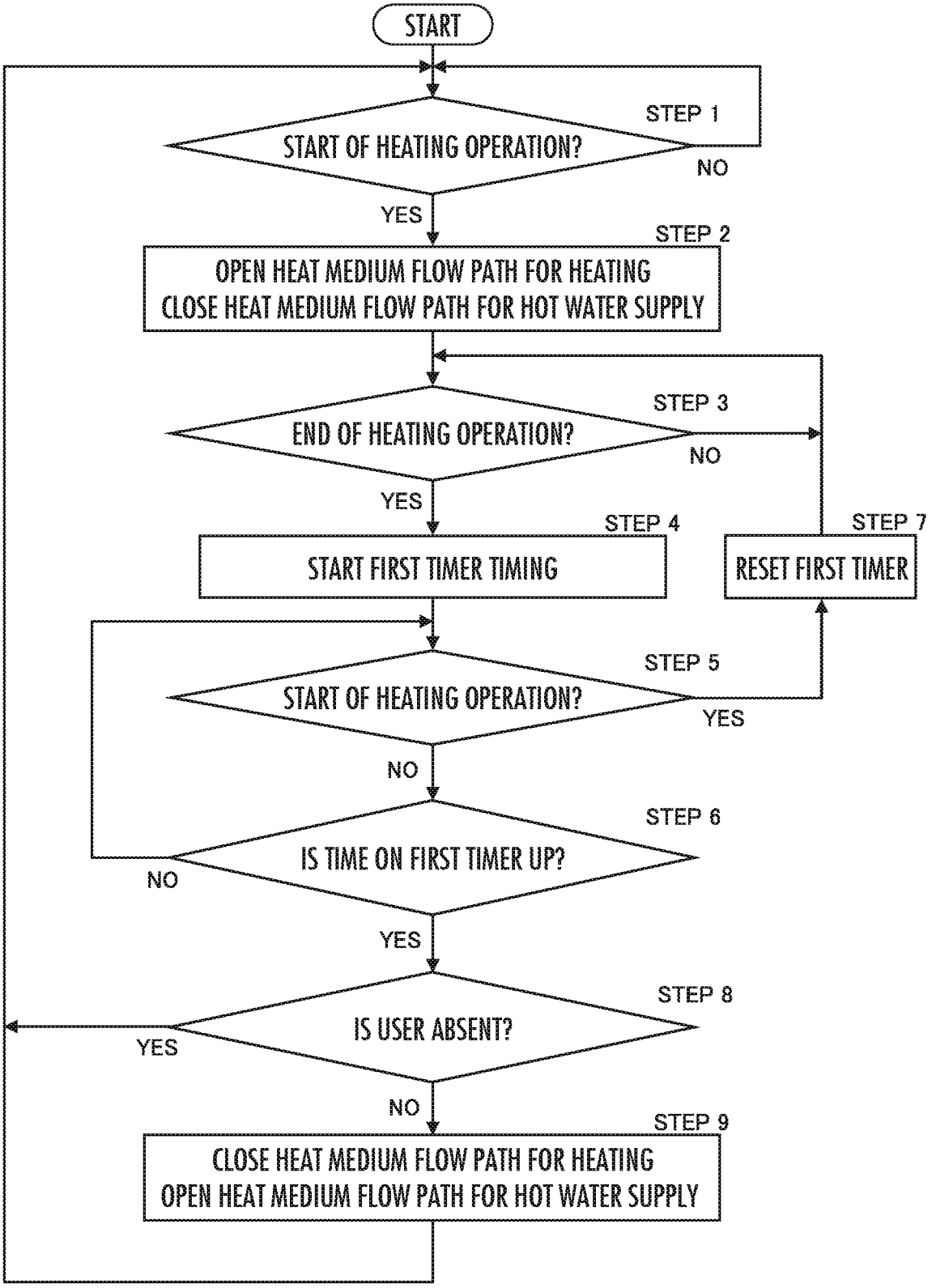
FIG. 2 is a flowchart illustrating the operation of a switching control unit.

Referring to FIG. 2, if it is determined in STEP 1 that the heating operation is started, then the switching control unit 27 proceeds to STEP 2 to actuate the switching valve 21 to open the heat medium flow path for heating 4 and close the heat medium flow path for hot water supply 5. This sets the heat medium flow path to the air conditioning ready state.

Subsequently, if it is determined in STEP 3 that the heating operation is terminated, then the switching control unit 27 proceeds to STEP 4 to start timing by the first timer 29. On the first timer 29, 24 hours is set as the timing time. The timing time of the first timer 29 corresponds to the air conditioning standby time. The timing time of the first timer 29 has been set to 24 hours in the present embodiment; however, the timing time is not limited thereto, and can be set to a relatively long time that exceeds a time during which the heating may be used again by the user after the heating operation is terminated.

Subsequently, if the switching control unit 27 proceeds to STEP 5 and finds that the heating operation is not yet started, then the switching control unit 27 returns to STEP 5 and monitors for a start of the heating operation until the time on the first timer 29 is up (until 24 hours pass after the end of the heating operation) in STEP 6.

If it is determined in STEP 5 that the heating operation is started, then the switching control unit 27 resets the first timer 29 in STEP 7 and returns to STEP 3, and repeats this until the time on the first timer 29 is up in STEP 6.

As described above, once the heating operation is performed, the heat medium flow path remains in the air conditioning ready state for 24 hours, thus enabling the hot-water supply apparatus 1 to stand by in a state for a quick startup when the heating is started.

When the time on the first timer 29 is up (when 24 hours have elapsed from the end of the heating operation) in STEP 6, the switching control unit 27 proceeds to STEP 8 and determines whether the user is absent (whether the absence of the user has been detected by the absence detection unit 28). If the user is not absent, then the switching control unit 27 proceeds to STEP 9 and closes the heat medium flow path for heating 4 and opens the heat medium flow path for hot water supply 5, and returns to STEP 1. This causes the hot-water supply apparatus 1 to stand by in the hot-water supply ready state.

If the heating operation is not performed even after 24 hours elapse since the end of the heating operation, then it can be assumed that the temperature has risen (a season has come in which the air conditioning operation is no longer necessary) and it is considered that the possibility of using the heating operation thereafter is low. Hence, if 24 hours elapse after the end of the heating operation, then the hot-water supply ready state is set, thereby improving the startup for use of the hot-water supply. This leads to improved user-friendliness when the hot-water supply is used.

However, even when 24 hours have elapsed after the end of the heating operation, if the user is absent due to long-term outing, such as traveling, then it can be assumed that the heating operation has not been performed despite a low temperature. Therefore, if it is determined in STEP 8 that the user is absent, then the switching control unit 27 returns to STEP 1. In this state, the processing in STEP 9 is not carried out, so that the hot-water supply apparatus 1 stands by in the air conditioning ready state, in which the heat medium flow path for heating 4 is open and the heat medium flow path for hot water supply 5 is closed. This makes it possible to quickly obtain the heating effect when the user starts the heating operation after returning home. The switching control unit 27 may return to STEP 4 and monitor for a start of the heating operation if it is determined in STEP 8 that the user is absent.

The absence detection unit 28 detects the absence of the user if the hot-water supply is not used (the operation for opening the hot water tap 19 is not performed) during the period of time from STEP 4 to STEP 6 (during the period of time until the air conditioning standby time after the heat medium flow path is set for the air conditioning ready state elapses). As another method for the absence detection unit 28 to detect the absence of the user, an absence switch (not illustrated), for example, may be provided in the hot-water supply remote control 31 or the like, so that the user operates the absence switch before going out for a long time.

Although not illustrated, in the controller 25 of the present embodiment, if the hot-water supply operation is performed during the period of time from STEP 4 to STEP 6, then the switching control unit 27 starts the timing by the second timer 30 at the end of the hot-water supply operation and holds the heat medium flow path in the hot-water supply ready state until the time on the second timer 30 is up. The timing time set on the second timer 30 is shorter than that set on the first timer 29. In the present embodiment, three minutes is set as the timing time on the second timer 30; however, the timing time is not limited thereto, and can be set, estimating the interval of opening and closing of the hot water tap 19 when the hot-water supply is used.

Thus, even if, for example, the hot water tap 19 is opened and closed a plurality of times within a short period of time, a quick startup of tapping is obtained during that time, resulting in improved user-friendliness.

In the present embodiment, the switching valve 21, which is a so-called three-way valve, has been used as the flow path switching unit to simplify the structure. Alternatively, however, each of the heat medium flow path for heating 4 and the heat medium flow path for hot water supply 5 may be provided with a separate on-off valve (not illustrated) serving as the flow path switching unit.

Further, the hot-water supply apparatus 1 of the present embodiment is provided with the combustion unit 2 for heating the heat medium of the heat medium generation passage 3, indicating the configuration for performing only the heating operation as the air conditioning operation; however, the present invention is not limited thereto. Alternatively, for example, a heat pump 34 for heating the heat medium in the heat medium generation passage 3 may be provided, the configuration being schematically illustrated in FIG. 3.

Figure 3:
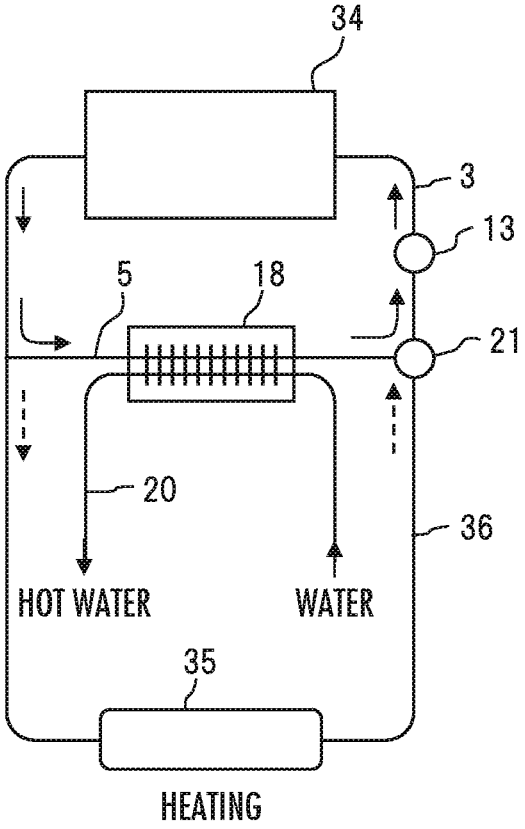
FIG. 3 is a diagram schematically illustrating the configuration of another hot-water supply apparatus.
Figure 4:
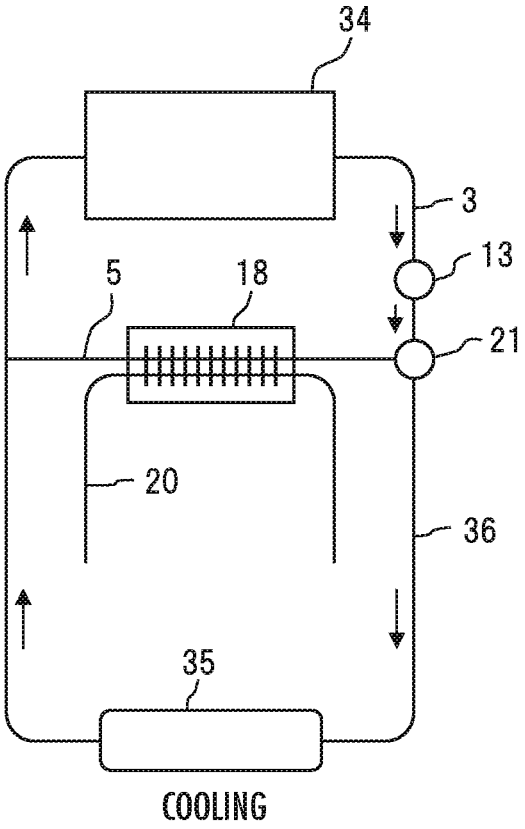
FIG. 4 is a diagram illustrating the cooling operation of the hot-water supply apparatus of FIG. 3.

If the heat pump 34 is adopted, then a cooling and heating operation can be performed as the air conditioning operation. More specifically, as illustrated in FIG. 3, the heat pump 34 is operated to heat the heat medium so as to perform the hot-water supply operation and the heating operation by an air conditioning terminal 35. Further, as illustrated in FIG. 4, the heat pump 34 is operated to cool the heat medium so as to feed a cooled heat medium to a heat medium flow path for air conditioning 36 by the reverse rotation of the circulation pump 13, thereby performing the cooling operation by the air conditioning terminal 35.

In the cooling operation, if the cooling operation is not performed when 24 hours (the air conditioning standby time) have elapsed from an end of the cooling operation, then it can be assumed that a temperature has fallen (a season in which the air conditioning operation is no longer necessary has come) and can be considered that the possibility of using the cooling operation thereafter is low. Therefore, as with the heating operation described above, when 24 hours have elapsed from the end of the cooling operation, the hot-water supply ready state is set, thus improving the startup when the hot-water supply is used. This leads to improved user-friendliness for using the hot-water supply.

DESCRIPTION OF REFERENCE NUMERAL

1 . . . hot-water supply apparatus; 2 . . . combustion unit; 3 . . . heat medium generation passage (heat medium flow path); 4 . . . heat medium flow path for heating (heat medium flow path); 5 . . . heat medium flow path for hot water supply (heat medium flow path); 13 . . . circulation pump (pump unit); 19 . . . hot water tap (operation unit); 21 . . . switching valve (flow path switching unit); 27 . . . switching control unit; 28 . . . absence detection unit; 31 . . . hot-water supply remote control (operation unit); 32 . . . heating remote control (operation unit); 34 . . . heat pump; and 36 . . . heat medium flow path for air conditioning (heat medium flow path).

What is claimed is:

1. A hot-water supply apparatus comprising:

an operation unit that enables a user to select either an air conditioning mode or a hot-water supply mode;

a flow path switching unit that switches a heat medium flow path according to an air conditioning ready state or a hot-water supply ready state;

a switching control unit that controls the flow path switching unit; and a pump unit that forcibly causes a heat medium in the heat medium flow path to flow, wherein the switching control unit actuates the flow path switching unit to switch the heat medium flow path to the hot-water supply ready state in a case where no operation for using air conditioning is performed through the operation unit by a time an air conditioning standby time set in advance elapses during standby, with the heat medium flow path being set to the air conditioning ready state while the pump unit is at rest.

2. The hot-water supply apparatus according to claim 1, wherein the switching control unit sets the heat medium flow path to the hot-water supply ready state until a hot-water supply standby time set in advance to be shorter than the air conditioning standby time elapses, in a case where the flow path switching unit is actuated to switch the heat medium flow path to the hot-water supply ready state in response to an operation for using the hot water supply performed through the operation unit, while waiting for the elapse of the air conditioning standby time with the heat medium flow path being set to the air conditioning ready state.

3. The hot-water supply apparatus according to claim 1, including:

a combustion unit that heats a heat medium in the heat medium flow path.

4. The hot-water supply apparatus according to claim 1, including:

a heat pump that selectively performs a heating operation for heating a heat medium in the heat medium flow path or a cooling operation for cooling the heat medium in the heat medium flow path.

5. A hot-water supply apparatus comprising:

an operation unit that enables a user to select either an air conditioning mode or a hot-water supply mode;

a flow path switching unit that switches a heat medium flow path according to an air conditioning ready state or a hot-water supply ready state;

a switching control unit that controls the flow path switching unit; and a pump unit that forcibly causes a heat medium in the heat medium flow path to flow, wherein an absence detection unit that detects absence of a user is provided, while the switching control unit is standing by, with the heat medium flow path being set to the air conditioning ready state while the pump unit is at rest, the flow path switching unit is actuated to switch the heat medium flow path to the hot-water supply ready state in a case where the absence of the user is not detected by the absence detection unit and no operation for using air conditioning is performed through the operation unit by a time an air conditioning standby time elapses, and in a case where the absence of the user is detected by the absence detection unit, the heat medium flow path is held in the air conditioning ready state even in the case where an operation for using the air conditioning is not performed through the operation unit by the time the air conditioning standby time elapses.

6. The hot-water supply apparatus according to claim 5, wherein the absence detection unit detects the absence of the user in a case where the operation for using the hot-water supply through the operation unit is not performed by the time the air conditioning standby time elapses after the switching control unit sets the heat medium flow path to the air conditioning ready state.

7. The hot-water supply apparatus according to claim 5, wherein the switching control unit holds the heat medium flow path to the hot-water supply ready state until a hot-water supply standby time set in advance to be shorter than the air conditioning standby time elapses, in a case where the flow path switching unit is actuated to switch the heat medium flow path to the hot-water supply ready state in response to operation for using the hot water supply performed through the operation unit, while waiting for the elapse of the air conditioning standby time with the heat medium flow path being set to the air conditioning ready state.

8. The hot-water supply apparatus according to claim 5, including:

a combustion unit that heats the heat medium in the heat medium flow path.

9. The hot-water supply apparatus according to claim 5, including:

a heat pump that selectively performs a heating operation for heating the heat medium in the heat medium flow path or a cooling operation for cooling the heat medium in the heat medium flow path.

* * * * *